United States Patent [19]

Springer et al.

[11] 4,400,147

[45] Aug. 23, 1983

[54] FLUSHABLE ROTARY GEAR PUMP

[75] Inventors: Carl M. Springer, Park Ridge, Ill.; Bernd O. Theis, Dormagen, Fed. Rep. of Germany; Georg Wawra; Richard Juffa, both of Cologne, Fed. Rep. of Germany

[73] Assignees: Binks Manufacturing Company, Franklin Park, Ill.; Bayer Aktiengesellschaft, Fed. Rep. of Germany

[21] Appl. No.: 247,610

[22] Filed: Mar. 25, 1981

[51] Int. Cl.[3] ..... F01C 1/18; F04B 49/00

[52] U.S. Cl. ..... 418/206; 417/283; 417/310

[58] Field of Search ..... 417/310, 283, 284, 430, 417/431; 401/47; 418/131, 133, 134, 46, 94, 206

[56] References Cited

U.S. PATENT DOCUMENTS

| | | | |
|---|---|---|---|
| 2,808,004 | 10/1957 | Durant et al. | 417/283 |
| 3,130,673 | 4/1964 | Finstad | 417/310 |
| 3,806,283 | 4/1974 | Leverett | 417/310 |
| 4,073,605 | 2/1978 | Wakeman et al. | 417/310 |

*Primary Examiner*—John J. Camby

*Attorney, Agent, or Firm*—Gary, Juettner & Pyle

[57] ABSTRACT

Flushable rotary gear pumps for delivering fluidic material, such as liquid coating material, may quickly and thoroughly be flushed of material of one type in preparation for delivering material of another type. In one embodiment, a valve selectively establishes a bypass channel between an inlet to and an outlet from a pump, thereby to accommodate a relatively large volume flow of flushing media through the pump and supply and delivery lines therefor. In another embodiment, the valve is structured to monitor fluid pressure developed by the pump and to automatically control and limit the pressure to a maximum value should an overpressure condition develop. In yet other embodiments passages are provided internally of the pump for conveying flushing media to all exposed surfaces of the gears, gear shafts and pump body to flush the same of coating material, whereby the entirety of the pump may readily be cleansed. If desired, the various features may be combined in a single pump.

13 Claims, 10 Drawing Figures

FLUSHABLE ROTARY GEAR PUMP

BACKGROUND OF THE INVENTION

The present invention relates to rotary gear pumps, and in particular to improved rotary gear pumps which may readily be flushed of pumped material.

Color change systems for spray coating apparatus have particular application in industrial operations where articles or ware are to be spray coated at a spray station, or are to be coated as they move along a production line. Where the articles are required to be coated a wide variety of colors, it is generally not practical to establish separate spray stations or production lines for each color, or even to spray a long sequence of articles of one color, then another long sequence of articles of a second color, etc. Instead, it is desirable to be able to make color changes rapidly and simply at a single spray station.

Color change systems are useful in such cases, and provide for a variety of colors to be sprayed from a single spray gun. With many conventional systems, a plurality of supply containers of fluid, each of a different color and having a separate motor driven transfer pump or a source of pressurization for the container, are connected with a manifold through valve controlled ports. An outlet from the manifold connects with an inlet to the spray gun, and to spray material of a particular color the port valve associated therewith is opened to provide the fluid through the manifold to the gun. After completion of spraying coating material of a particular color, the manifold and gun are flushed with a flushing media of solvent and compressed air to clean the system in preparation for spraying material of a different color.

Although the foregoing types of color change systems provide versatility in spraying a plurality of different colored fluids with a single spray gun, requisite manifold flushing between color changes imposes time limitations on the color change process, which limitations become significant in use of high solids paints which do not flush rapidly. Consequently, such systems lack versatility for use with production lines in which rapid color changes are necessary.

In many spray coating applications it is necessary that the quantities of coating materials supplied to the spraying equipment be accurately metered or dosed, thereby to supply a specified amount of material to be applied on an article or, in the case of plural component systems, to maintain accurate ratios between the quantities of different material combined in a spray. For the purpose, rotary gear metering pumps are often used as part of or at the outlet from a color changer to deliver coating material to spray coating equipment.

Although rotary gear pumps are well suited for delivering metered quantities of coating material to spray coating apparatus, a difficulty arises in their use with color change equipment. Since the coating material passes through the pump, to change from spraying material of one color to spraying material of another, the pump must first be thoroughly cleansed to prevent contamination of coating material colors. Because of the particular structure of conventional rotary gear pumps, significant time delays are encountered in cleansing the same between color changes.

OBJECTS OF THE INVENTION

An object of the present invention is to provide a valve structure for use with a rotary gear pump, which selectively establishes a bypass channel between an inlet to and an outlet from the pump to enable a large volume flow of flushing media between the pump inlet and outlet and across the pump gears, thereby to facilitate flushing of the pump and supply and delivery lines therefor.

Another object of the invention is to provide such a valve for establishing a bypass channel, wherein the valve also automatically regulates the pressure developed by the pump to a maximum value should an overpressure condition occur.

A further object is to provide a rotary gear pump having passages therein for providing flushing media to all exposed interior surfaces of the pump to thoroughly clean the same.

SUMMARY OF THE INVENTION

In accordance with the present invention, there is provided an improved rotary gear pump of a type comprising a pump body having an inlet, an inlet chamber in communication with the inlet, an outlet and an outlet chamber in communication with the outlet. The pump includes first and second gears mounted on respective first and second shafts for rotation in meshed engagement in the body, and the gears mesh at a point between the inlet and outlet chambers for delivering fluidic material introduced through the inlet from the inlet chamber to the outlet chamber and the outlet.

In one embodiment, the improvement to the pump comprises the provision of passage means extending between and in communication with the inlet chamber and outlet chamber, and a valve for opening and closing the passage means. The valve includes a valve stem movable into and out of the passage means to respectively interrupt and establish a path therethrough, and motor means for moving the valve stem into and out of the passage means. In this manner, upon movement of the valve stem into the passage means the pump may be operated normally so that the gears then deliver fluidic material introduced into the inlet chamber to the outlet chamber, and upon movement of the valve stem out of the passage means a path is established for a flow of flushing media, introduced at the inlet, through the inlet chamber, passage means and outlet chamber to the outlet and across the teeth of the gears to clean the same.

Preferably, in the one embodiment the motor means moves the valve stem into the passage means with a controllable force, and the valve is configured so that the pressure of fluidic material delivered by the pump exerts a force on the valve stem which is proportional to the pressure and opposite in direction to the controllable force. Consequently, when the force exerted on the valve stem by the pressure of fluidic material exceeds the controllable force, the stem is moved in the direction out of the passage means to establish a path between the inlet chamber and the outlet chamber, thereby to limit the pressure of material in the outlet chamber. Accordingly, the valve automatically limits the pressure developed by the pump to a maximum valve determined by the controllable force and prevents the pump from developing an overpressure condition at its outlet.

In accordance with another embodiment of the invention, the improvement to the pump comprises at least a second inlet to the pump body, and passage means extending between the at least second inlet and spaced defined between adjacent surfaces of the shafts, pump body and gears. Thus, flushing fluid may be introduced at the at least second inlet and directed through the passage means into the spaces to clean the adjacent surfaces of the gears, shafts and pump body.

The invention also contemplates combining in a single pump all of the foregoing embodiments of the invention, whereby flushing media may be introduced into the pump to clean the entirety of the internal surfaces thereof.

The foregoing and other objects, advantages and features of the invention will become apparent upon a consideration of the following detailed description, when taken in conjunction with the accompanying drawings.

DETAILED DESCRIPTION

Figure 1:
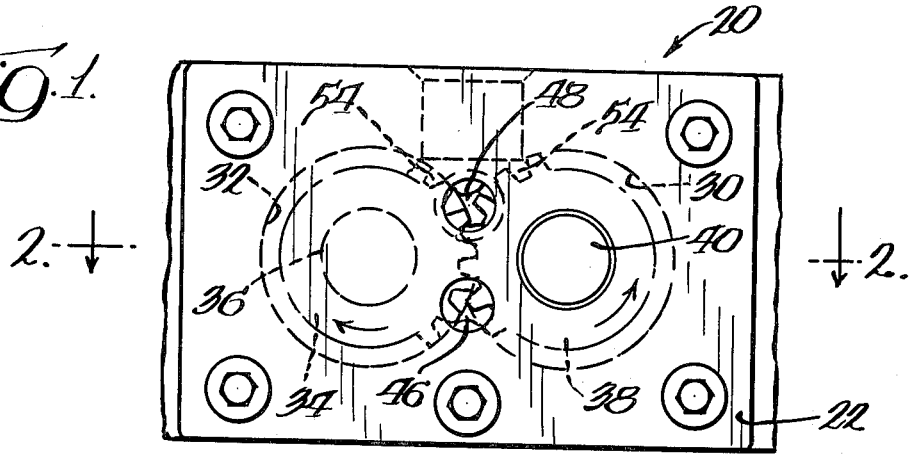
FIG. 1 is a front elevation view, partly in cross section, showing the arrangement of metering gears of a rotary gear pump with respect to an inlet to and an outlet from the pump.
Figure 2:
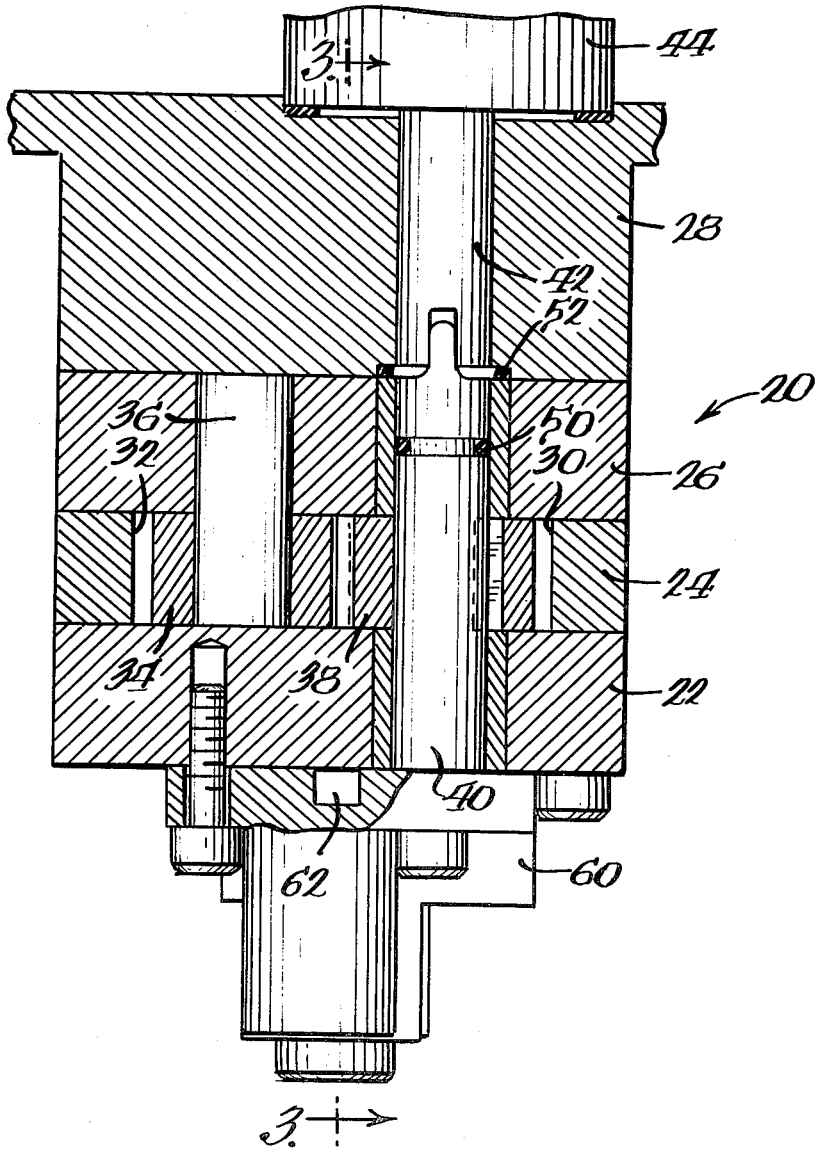
FIG. 2 is a plan view, partly in cross section, taken along the lines 2—2 of FIG. 1, and illustrates the mounting of the metering gears on shafts in the pump and portions of a valve assembly for establishing a bypass channel between an inlet to and an outlet from the pump.

Referring to FIGS. 1 and 2, there is indicated generally at 20 a rotary gear pump of a type with which the teachings of the invention may advantageously be used. The pump includes a front plate 22, a center plate 24, a rear plate 26 and a motor housing 28, and the center plate has circular openings 30 and 32 therein. A driven or idler gear 34 is closely received within the opening 32 and mounted for rotation on a shaft 36, and a driving gear 38 is closely received within the opening 30, meshed with the idler gear and mounted for rotation on a driving shaft 40. The shaft 40 is splined to an output shaft 42 of a motor 44 mounted on the housing 28, whereby energization of the motor rotates the gear 38 and thus the gear 34. An inlet chamber 46 in the plates 24 and 26 is to one side of the point of meshing between the gears, an outlet chamber 48 is in the plates to an opposite side, an O-ring 50 seals the driving shaft in the rear plate and an O-ring 52 seals between the rear plate and motor housing.

As is known, upon introduction of fluidic material into the inlet chamber 46, as the metering gears 34 and 38 rotate each tooth space 54 of the gears fills with material as it passes through the inlet chamber. Then, as the gears continue to rotate, the material is confined in the spaces by the inner walls of the openings 30 and 32 until it reaches the outlet chamber 48 where the gear mesh and force the material out through a discharge opening. Inasmuch as the volumetric capacity of the teeth spaces is known and the speed of rotation of the gears may be controlled, the pump is capable of metering or delivering exact quantities of material generally irrespective of varying conditions of viscosity, pressure and temperature of the material.

To the extent described the pump is conventional, and when used to supply coating material to spray paint apparatus must be flushed of coating material upon changing from material of one color to material of another. To clean the pump, it has heretofore been customary to introduce a flushing media, which usually comprises alternate applications of solvent and compressed air, at the inlet of the pump, while operating the pump until it is clean. However, because of irregular and closely spaced surface areas of the pump parts, cleaning the pump is not only time consuming, but also the resulting cleanliness of the pump is often less than satisfactory.

In improving upon the ability to clean the pump, in accordance with one embodiment of the invention the front plate 22 is structured to accommodate access to the sides of the gears 34 and 38 opposite the inlet and outlet ports 46 and 48 by the provision of flushing ports aligned respectively with the inlet and outlet ports, the provision of a bypass channel joining the flushing ports and the addition of a penumatically operated valve for opening and closing the bypass channel. When the valve is closed, the pump operates normally. By supplying flushing media to the inlet port and opening the valve either continuously or intermittently, flushing media may be rapidly passed through the pump supply and return lines (not shown), the inlet and outlet chambers, the flushing ports, the bypass channel and across the gear teeth, thereby rapidly flushing the interior of the pump and the supply and return lines of coating material.

Figure 3:
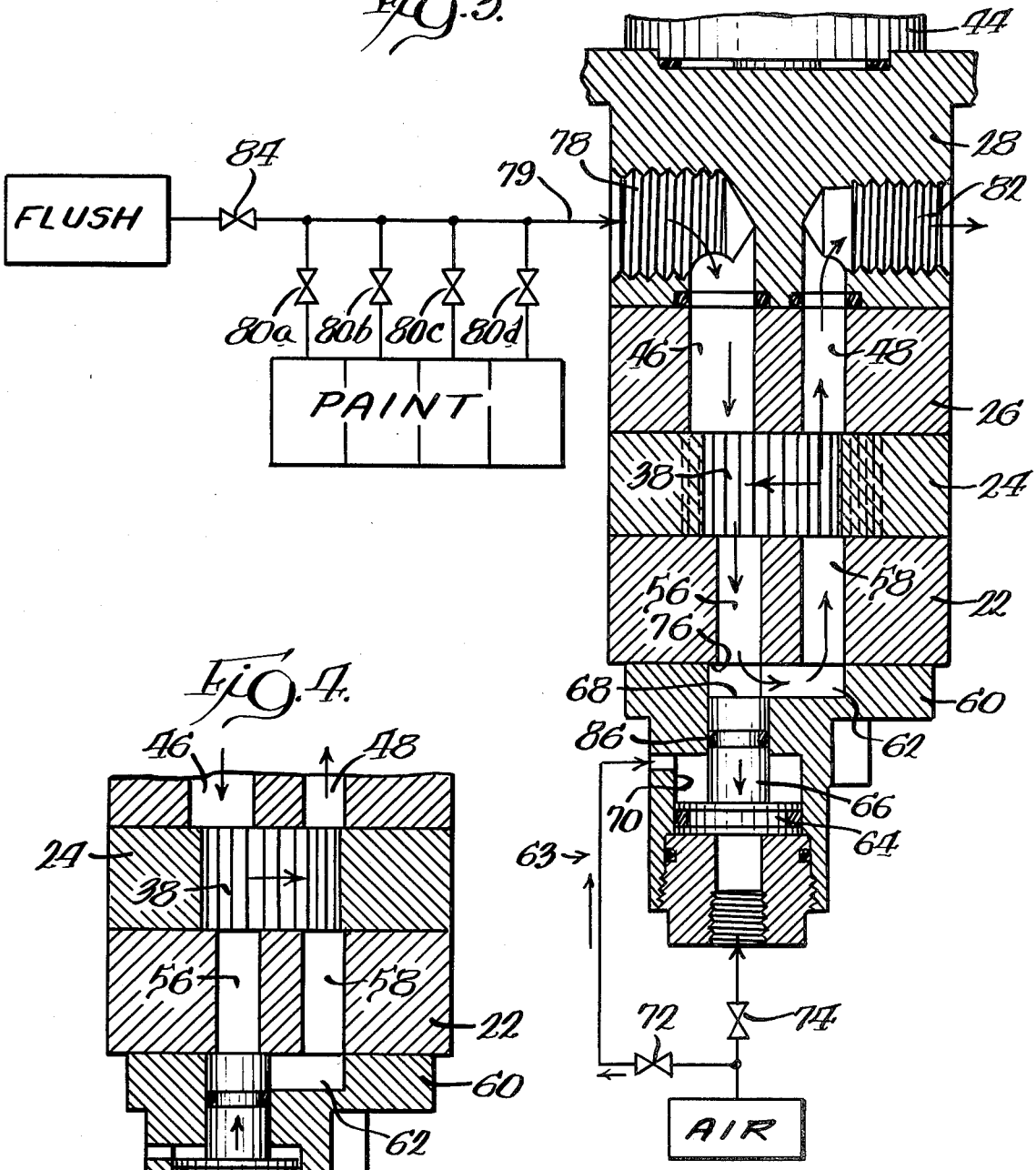
FIG. 3 is a cross sectional side elevation view taken substantially along the lines 3—3 of FIG. 2, and illustrates structural details of the valve, showing the same in its open state for establishing the bypass channel.
Figure 4:
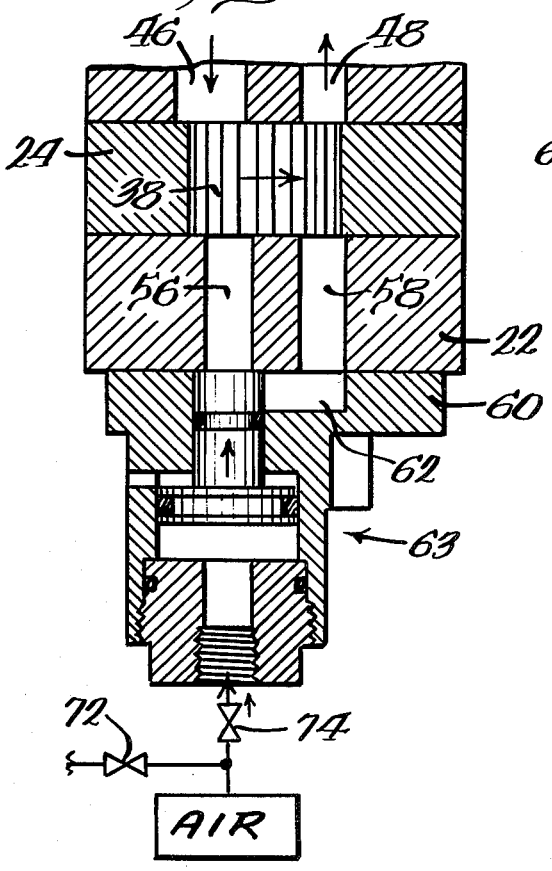
FIG. 4 is similar to FIG. 3, except that the valve is shown closing the bypass channel at the inlet side of the pump.

Referring to all of FIGS. 2–4, a first bypass port 56 is formed through the plate 22 in alignment with the inlet chamber 46, a second bypass port 58 is formed through the plate in alignment with the outlet chamber 48 and a valve housing 60 is mounted on the plate over the ports 56 and 58. A bypass channel 62 extending between the ports is in the housing, and the housing includes therein a pneumatically actuated valve, indicated generally at 63, which has a piston 64 and a piston rod 66 defining a valve 68 at its end. The piston is movable within a cylinder 70 toward and away from the pump body upon application of air under pressure to one side or the other of the piston by selective opening of a valve 72 or 74, and when moved toward the pump the end 68 of the rod moves against a valve seat 76 to close the port 56 and thereby the passage through the bypass channel.

To deliver coating material to spray paint equipment the valve 72 is opened so that the valve 63 establishes a path through the bypass channel. An inlet 78 to the pump is then connected through a supply line 79 with coating material of a selected color by opening a respective one of a plurality of coating material supply valves 80*a–d,* each of which connects with an associated supply container of coating material. Coating material then passes through the inlet chamber 46 to the gears 34 and 38, which carry the material in the spaces 54 between the gear teeth to the outlet chamber 48 and a pump outlet 82, as well as through the bypass channel to the outlet chamber, for whence the material is applied through a delivery line (not shown) to spray paint equipment (not shown). Opening of the bypass channel while the system is being filled with coating material considerably shortens the time required to fill the system, which would otherwise be limited to the delivery rate of the pump, whereafter the valve 72 is closed and the valve 74 opened to close the bypass channel so that the pump operates normally in delivering metered amounts of coating material to the spray paint equipment.

Upon completion of spraying coating material of one color and in preparation for spraying material of another, all of the valves 80*a–d* are closed, a valve 84 is opened to connect a supply of flush media with the inlet to the pump and the valve 74 is closed and the valve 72 opened to operate the valve 63 to open the bypass channel 62. Under this condition and with the pump operating, a relatively large volume of flush media may flow between the pump inlet 78 and outlet 82 through the inlet and outlet chambers 46 and 48, the ports 56 and 58, the bypass channel and across the teeth of the gears 34 and 38 to rapidly cleanse the pump and pump supply and return lines of coating material. Thereafter, the flush valve 84 is closed and a selected one of the coating material valves 80*a–d* is opened to supply the next selected color of coating material to the spray paint equipment.

It is appreciated that the particular structure of the bypass valve 63 affords advantages over use of, for example, a spool valve in the bypass channel. To this end, only a single O-ring seal 86 is required to seal the valve from material in the channel, and the seal is never placed within the channel. Consequently, there are no problems associated with sticking of the valve incident to buildup of coating material around the seal and the valve always remains freely movable.

Another advantage of the valve 63 is that it may be used to automatically control and limit overpressure conditions developed by the pump. As is known, a rotary gear pump is capable of developing significant pressures at its output, for example on the order of 10,000 psi, and pressure transducers are often used to sense the pressure and control operation of the pump, or open a shunt path between the pump inlet and outlet, to prevent occurrence of an overpressure condition. Should the transducer fail to operate, sufficient pressure may be developed by the pump to rupture material delivery lines and/or damage the spray paint equipment.

Figure 5:
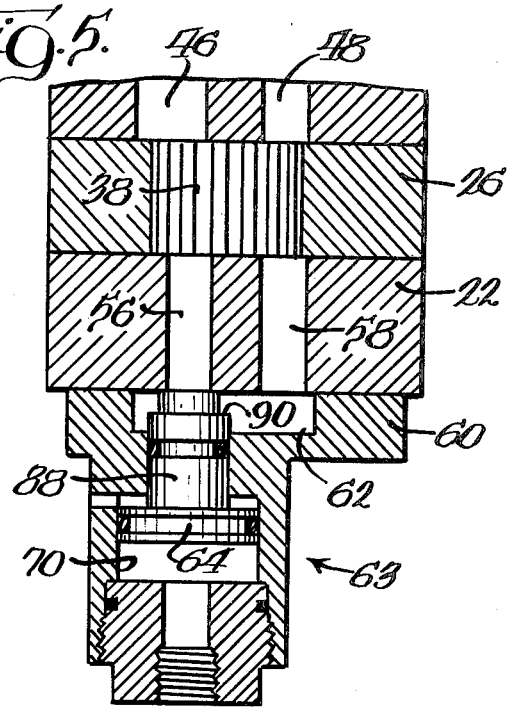
FIG. 5 is similar to FIG. 4, and shows an alternate embodiment of the valve for relieving pump overpressure conditions.

FIG. 5 illustrates an embodiment of the bypass channel valve 63 for automatically controlling and limiting the maximum pressure that may be developed at the pump outlet. The valve operates in the same manner as discussed in connection with FIGS. 3 and 4 to establish or interrupt a path through the bypass channel 62, but unlike the valve illustrated in FIGS. 3 and 4, the valve in FIG. 5 has a piston rod 88 which is provided with a shoulder 90 toward an end thereof. When the valve is operated to close the bypass channel the shoulder is within the channel, and defines a surface against which the pressure of coating material in the channel, as transferred from the pump outlet through the port 58, exerts a force in proportion to the pressure and in a direction opposed to the force exerted on the piston 64 by air introduced through the valve 74. Should the force exerted on the shoulder by the pressure of material exceed the force exerted on the piston by air supplied through the valve 74, the piston rod and piston will be moved in the direction opening the bypass channel and establishing a path for a flow of material between the outlet from and the inlet to the pump to limit the outlet pressure to a maximum value and relieve the overpressure condition. Consequently, by controlling the pressure of air supplied through the valve 74, the maximum pressure that may be developed at the pump outlet is automatically controlled and limited.

Figure 6:
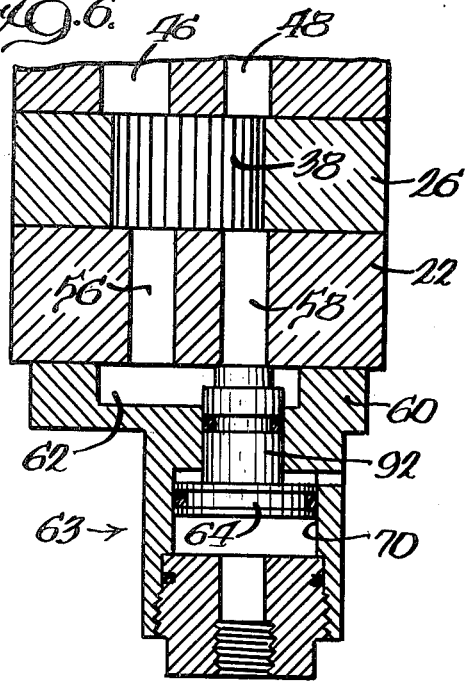
FIG. 6 is similar to FIG. 4, except that the valve is positioned to close the bypass channel at the outlet side of the pump to relieve pump overpressure conditions.

In the arrangement of bypass channel valve 63 illustrated in FIG. 6, the valve is positioned so that the end of a piston rod 92 is adapted to close the opening between the bypass channel 62 and the port 58, instead of the port 56. Consequently, the pressure of material at the outlet from the pump exerts against the end of the rod a force which is proportional to the pressure and opposite in direction to the force exerted on the piston 64 by air introduced through the valve 74, whereby upon development sufficient pressure at the outlet from the pump the valve is moved in the direction to open the bypass channel and establish a path between the outlet from and the inlet to the pump to limit the outlet pressure to a maximum value and relieve the overpressure condition. Thus, by regulating the pressure of air introduced through the valve 74 into the cylinder 70, the maximum pressure developed by the pump may be automatically limited and controlled. If desired, mechanical movement of the valve in response to development of an overpressure condition by the pump may be sensed and a signal generated to warn an operator of the system of an error condition.

It is appreciated that while the bypass channel and bypass valve have been illustrated and described as generally comprising a portion of the pump structure, the same could be separate. For example, the housing 60 could be eliminated and a bypass valve structure remote from the pump be connected with the ports 56 and 58 through conduits. Also, a bypass valve could be connected between the pump inlet 78 and outlet 82 for rapid flushing of the supply and delivery lines, although rapid flushing of the pump itself would not be accommodated. In the alternative, for rapid flushing of the pump and supply and delivery lines flushing media introduced at the inlet 78 could simply be allowed to pass through the port 56 to a dump or point of collection, while at the same time flushing media would also be introduced into the port 58.

Use of a bypass channel and bypass valve offers significant advantages in rapidly filling and flushing the pump and associated supply and delivery lines. However, and while rotary gear pumps are manufactured to relatively close tolerances, finite spaces exist between the gears, the pump body and the gear shafts which fill with coating material in use of the pump and are not readily cleaned during flushing using the bypass channel. Such material, if left in the spaces, would contaminate a subsequently delivered color of coating material.

Figure 7:
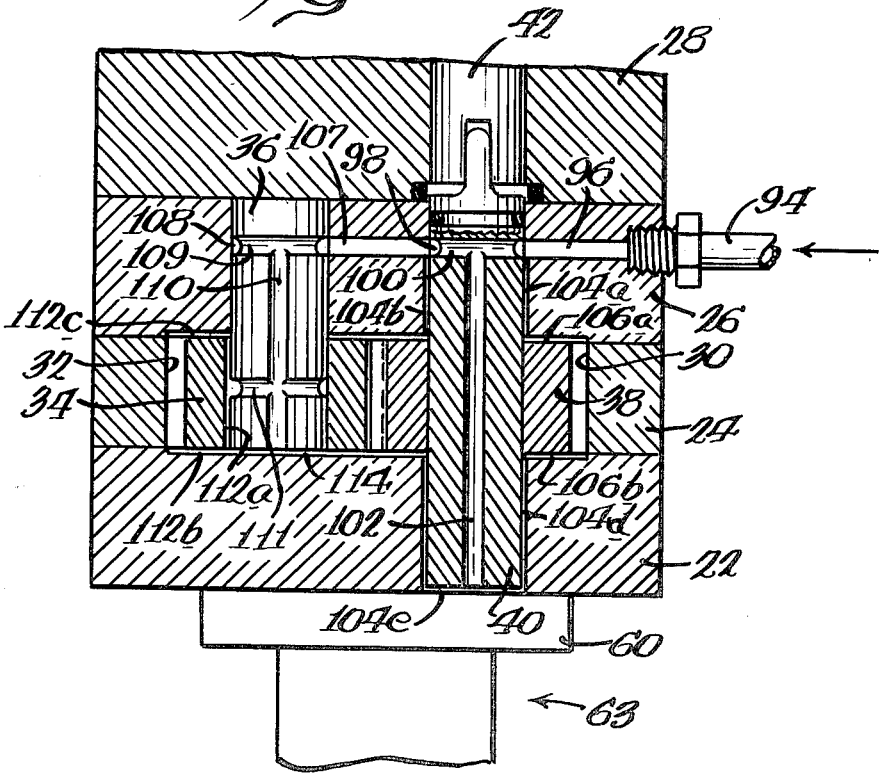
FIGS. 7–10 illustrate embodiments of pumps in which separate passage are formed in the pumps for distributing flushing media to all exposed interior surfaces to quickly and thoroughly cleanse the same of pumped material.

Accordingly, to thoroughly clean the pump between color changes, the invention also contemplates a pump structure which enables all exposed interior surfaces of the pump to be contacted and cleansed by flushing media. Referring to FIG. 7, there is shown a gear pump of a type in which the driving gear 38 is pressed onto the driving shaft 40 so that no space exists therebetween, in which the shaft 36 is stationary and pressed into the plate 26 so that no space exists therebetween, and wherein the driven or idler gear 34 rotates about the shaft 36. An inlet fitting 94 for being connected with a supply of flushing media (not shown) is in the plate 26, and communicates with a passage 96 extending through the plate to the opening for receiving the shaft 40. The shaft 40 has an annular recess 98 formed circumferentially therearound in communication with the passage 96, a passage 100 extends diametrically therethrough and communicates at opposite ends with the recess and a passage 102 extends axially therethrough between the passage 100 and an opposite end of the shaft. Consequently, and with the pump operating, flushing media introduced at the fitting flows through the passage 96, the recess 98 and the passages 100 and 102 and into spaces 104*a–e* between the driving shaft 40 and the pump body as well as spaces 106*a–b* between the sides of the gear 38 and the pump body, and exits therefrom by flowing into the spaces 54 between the teeth of the gear for being carried to and discharged from the pump outlet 84, whereby the entirety of the driving portion of the pump is cleansed of coating material.

To flush the driven portion of the pump, a passage 107 extends through the plate 26 between the recess 98 and an annular recess 108 formed circumferentially around the shaft 36. A passage 109 extends diametrically through the shaft and opens at opposite ends into the recess 108, a passage 110 extends axially through the shaft from the passage 109 to an opposite end of the shaft, and a passage 111 extends diametrically through the shaft in communication with the passage 110 and terminates at its ends in the space between the shaft and the gear 34. In this manner, flushing media introduced at the fitting 94 also flows through the passages 107, 109, 110 and 111 and the recess 108 into a space 112*a* between the gear 34 and the shaft 36, into spaces 112*b–c* between the sides of the gear and the pump body and into a space 114 between an end of the shaft and the pump body, and exits therefrom by flowing into the spaces 54 between the teeth of the gear 34 for being carried to and discharged from the pump outlet, whereby the entirety of the driven portion of the pump is thoroughly cleansed of coating material.

As is apparent, flushing media introduced at the fitting 94 does not pass through the inlet 78 to the pump, and the volume of flushing media is less than could otherwise be accommodated by introduction of flush at the pump inlet while establishing a bypass channel. Accordingly, to facilitate cleaning of the pump and its supply and delivery lines, it is contemplated that the embodiment of invention shown in FIG. 7 be combined with the embodiment in which a bypass channel is provided for the pump, or in which a large volume flow of flushing media may otherwise occur through the pump inlet and outlet chambers and supply and delivery lines.

Figure 8:
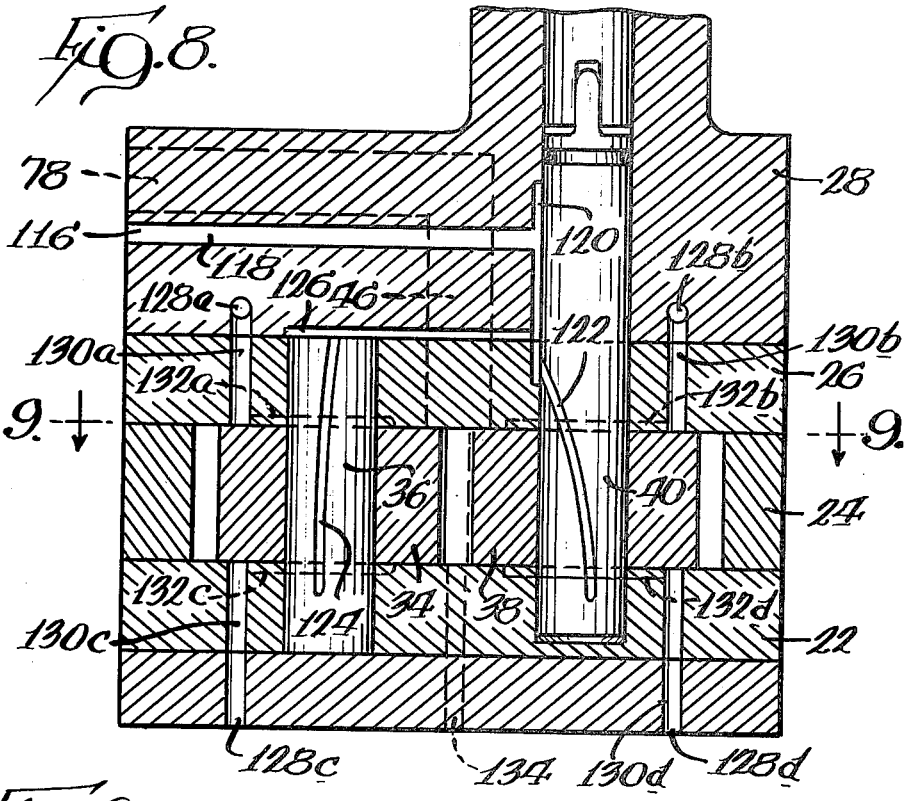
Figure 9:
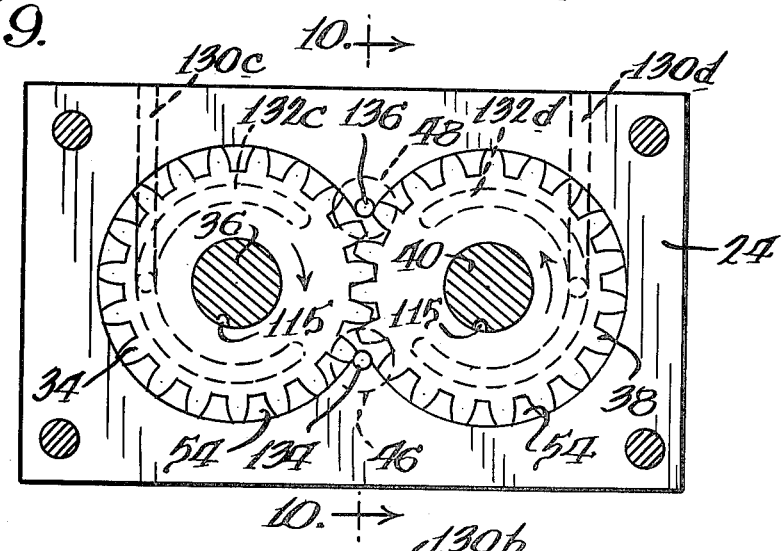
Figure 10:
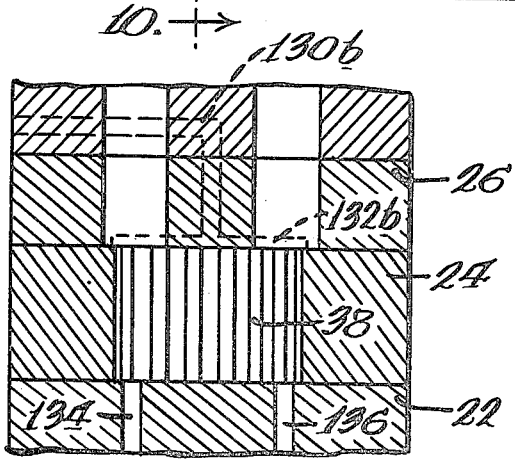

FIGS. 8–10 illustrate a further embodiment of pump structure which enables the entirety of the interior of the pump to be thoroughly cleaned when the pump is of a type in which the driven and driving shafts 36 and 40 are each rotatable within the pump body and the driven and driving gears 34 and 38 are secured by pins 115 to their associated shafts, such that spaces exist between the shafts, the gears and the pump body.

To clean the pump, an inlet 116 in the motor mount housing 28 is connected with a supply of flushing media (not shown), and communicates through a passage 118 with a chamber 120 formed in the housing and plate 26 adjacent to and extending along the shaft 40. A spiral channel or groove 122 is formed in and along the surface of the shaft and communicates one end thereof with the chamber, the arrangement being such that a portion of the groove is always exposed to the chamber during rotation of the shaft. Also, a channel or groove 124 is formed in the surface of the shaft 36 and communicates with the chamber through a channel 126 formed in the housing 28, the channel 126 being of a size such that the groove 124 always remains in communication therewith during rotation of the shaft 36. Thus, flushing media introduced at the inlet 116 enters the chamber 120 and the grooves 122 and 124, and thence flows into and through all of the spaces between the shafts 36 and 40 and the adjacent surfaces of the gears and pump body to clean the same.

To clean the spaces between the sides of the gears 34 and 38 and adjacent body portions of the pump, a plurality of inlets 128*a–d* to the pump are also connectable with the supply of flushing media, and communicate through associated passages 130*a–d* with respective semi-circular grooves 132*a–d* formed in the plates 22 and 26 adjacent the sides of the gears. Consequently, flushing media introduced at the inlets 128*a–d* enters the grooves 132*a–d* and flows into the spaces between the sides of the gears and the plates to thoroughly clean the same. It is understood, of course, that flushing media introduced into the pump at the inlets 116 and 128*a–d* ultimately enters the spaces 54 between the teeth of the gears 34 and 38 and is carried to and discharged from the pump outlet.

To facilitate cleaning of the coating material inlet and outlet passages and the material supply and delivery lines, the supply of flush may also be connected with a pair of passages 134 and 136 which communicate respectively with the inlet chamber 46 and the outlet chamber 48. During connection of the supply of flush with the passages, the supply and delivery lines are opened at their ends remote from the pump, so that flush introduced into the passages flows through the chambers 46 and 48, the pump inlet 78 and outlet 82 and the supply and delivery lines to thoroughly cleanse the same. In the alternative, it is also contemplated that the passages 134 and 136 may be selectively interconnected by an integral or remote valve controlled bypass channel, so that flushing of the pump occurs in a manner as previously described.

It is appreciated, of course, that the illustrated and described arrangements of flushing channels and passages in the pumps are representative of only two of many arrangements that may be used, it only being necessary that flushing media be directed across the various surfaces of a pump which are contacted by coating material.

While embodiments of the invention have been described in detail, various modifications and other embodiments thereof may be devised by one skilled in the art without departing from the spirit and scope of the invention, as defined in the appended claims.

What is claimed is:

1. In a rotary gear pump of a type for metering precise quantities of fluidic material and comprising a pump body having an inlet for connection with a supply line, an inlet chamber in communication with said inlet, an outlet for connection with a delivery line, an outlet chamber in communication with said outlet and first and second gears mounted for rotation in meshed engagement in said body, said gears meshing at a point between said inlet chamber and said outlet chamber for delivering fluidic material introduced through said inlet from said inlet chamber to said outlet chamber and said outlet, the improvement comprising first passage means in communication with said inlet and outlet; and a valve for opening and closing said first passage means, said valve including a valve stem movable into said first passage means to interrupt a path therethrough and out of said first passage means to establish a path therethrough, and motor means for moving said valve stem into and out of said first passage means, whereby upon movement of said valve stem into said first passage means said pump may be operated normally so that said gears then deliver fluidic material introduced into said inlet chamber to said outlet chamber, and upon movement of said valve stem out of said first passage means a path is established for a flow of flushing media, introduced at said inlet through the supply line, between said inlet and said outlet and through said first passage means and the delivery line to clean the same, wherein said first and second gears are mounted for rotation on respective first and second shafts in said body, and including at least a second inlet to said body separate from said first mentioned inlet, said outlet and said inlet and outlet chambers and second passage means in said body separate from said first mentioned inlet, said outlet and said inlet and outlet chambers and extending between said at least second inlet and spaces defined between adjacent surfaces of said shafts, pump body and gears, and means for connecting a supply of flushing media with said at least second inlet, whereby flushing media may be introduced at said at least second inlet and through said second passage means into said spaces to clean said adjacent surfaces of the fluidic material.

2. In a pump as in claim 1, wherein said second passage means comprises a first passage in said first shaft in communication with spaces between adjacent surfaces of said first shaft, pump body and said first gear, a second passage in said second shaft in communication with spaces between adjacent surfaces of said second shaft, pump body and said second gear, and conduit means in said pump body for connecting said first and second passages with said at least second inlet.

3. In a pump as in claim 2, wherein said first passage comprises a circumferential groove in the surface of said first shaft toward one end thereof and a channel in said shaft extending between said groove and an opposite end of said shaft, said second passage comprises a circumferential groove in the surface of said second shaft toward one end thereof and a channel in said shaft extending between said groove and both a point on the surface of said shaft adjacent an inner surface of said second gear and an opposite end of said shaft, and said conduit means extends between and connects said at least second inlet and said circumferential grooves.

4. In a pump as in claim 1, wherein said second passage means comprises a first chamber in said body adjacent to, opening upon and extending along said first shaft toward one end thereof, a spiral groove in and extending along the surface of said first shaft generally along the length thereof, said spiral groove being in communication with said first chamber, a groove in and extending along the length of said second shaft, a second chamber in said body communicating between said first chamber and said groove in said second shaft, and conduit means connecting said first and second chambers, said spiral groove and said groove with said at least second inlet.

5. In a pump as in claim 1 or 4, wherein said second passage means includes first, second, third and fourth channels formed in said pump body adjacent to and opening upon associated side surfaces of said first and second gears, and wherein said second passage means connects said first, second, third and fourth channels with said at least second inlet.

6. In a pump as in claim 5, wherein said first, second, third and fourth channels are semi-circular and generally coaxial with said first and second shafts.

7. In a rotary gear pump of a type for metering precise quantities of fluidic material and comprising a pump body having an inlet for connection with a supply line, an inlet chamber in communication with said inlet, an outlet for connection with a delivery line, an outlet chamber in communication with said outlet and first and second gears mounted for rotation on respective first and second shafts in meshed engagement in said body, said gears meshing at a point between said inlet chamber and said outlet chamber for delivering fluidic material introduced through said inlet from said inlet chamber to said outlet chamber and said outlet, the improvement comprising first passage means extending between and in communication with said inlet and said outlet; a valve for opening and closing said first pasage means, whereby upon said valve closing said first passage means said pump may be operated normally so that said gears then deliver fluidic material introduced into said inlet chamber to said outlet chamber, and upon said valve opening said first passage means a path is established for a flow of flushing media, introduced at said inlet through the supply line, between said inlet and said outlet and through said first passage means and the delivery line to clean the same; at least a second inlet to said body separate from said first mentioned inlet, said outlet and said inlet and outlet chambers; second passage means in said body separate from said first mentioned inlet, said outlet and said inlet and outlet chambers and extending between said at least second inlet and spaces defined between adjacent surfaces of said shafts, pump body and gears, and means for connecting a supply of flushing media with said at least second inlet, whereby flushing media may be introduced at said at least second inlet and through said at least second passage means into said spaces to clean said adjacent surfaces of the fluidic material.

8. In a rotary gear pump of a type for metering precise quantities of fluidic material and comprising a pump body having an inlet, an inlet chamber in communication with said inlet, an outlet, an outlet chamber in communication with said outlet and first and second gears mounted for rotation on respective first and second shafts in meshed engagement in said body, said gears meshing at a point between said inlet chamber and said outlet chamber for delivering fluidic material introduced through said inlet from said inlet chamber to said outlet chamber and said outlet, the improvement comprising at least a second inlet to said body separate from said first mentioned inlet, said outlet and said inlet and outlet chambers, passage means in said body separate from said first mentioned inlet, said outlet and said inlet and outlet chambers and extending between said at least second inlet and spaces defined between adjacent surfaces of said shafts, pump body and gears, and means for connecting a supply of flushing media with said at least second inlet, whereby flushing media may be introduced at said at least second inlet and through said passage means into said spaces to clean and adjacent surfaces of the fluidic material.

9. In a pump as in claim 7, wherein said passage means comprises a first passage in said first shaft in communication with spaces between adjacent surfaces of said first shaft, pump body and said first gear, a second passage in said second shaft in communication with spaces between adjacent surfaces of said second shaft, pump body and said second gear, and conduit means in said pump body for connecting said first and second passages with said at least second inlet.

10. In a pump as in claim 9, wherein said first passage comprises a circumferential groove in the surface of said first shaft toward one end thereof and a channel in said shaft extending between said groove and an opposite end of said shaft, said second passage comprises a circumferential groove in the surface of said second shaft toward one end thereof and a channel in said shaft extending between said groove and both a point on the surface of said shaft adjacent an inner surface of said second gear and an opposite end of said shaft, and said conduit means extends between and connects said at least second inlet and said circumferential grooves.

11. In a pump as in claim 8, wherein said passage means comprises a first chamber in said body adjacent to, opening upon and extending along said first shaft toward one end thereof, a spiral groove in and extending along the surface of said first shaft generally along the length thereof, said spiral groove being in communication with said first chamber, a groove in and extending along the length of said second shaft, a second chamber in said body communicating between said first chamber and said groove in said second shaft, and conduit means connecting said first and second chambers, said spiral groove and said groove with said at least second inlet.

12. In a pump as in claim 8 or 11, wherein said second passage means includes first, second, third and fourth channels formed in said pump body adjacent to and opening upon associated side surfaces of said first and second gears, and wherein said second passage means connects said first, second, third and fourth channels with said at least second inlet.

13. In a pump as in claim 12, wherein said first, second, third and fourth channels are semi-circular and generally coaxial with said first and second shafts.

* * * * *

UNITED STATES PATENT OFFICE

CERTIFICATE OF CORRECTION

PATENT NO. : 4,400,147

DATED : August 23, 1983

INVENTOR(S) : Carl M. Springer, Bernd O. Theis, Georg Wawra and Richard Juffa

It is certified that error appears in the above-identified patent and that said Letters Patent are hereby corrected as shown below:

Claim 8, column 11, line 4, "and" should read --said--.

Claim 9, column 11, line 6, "7" should read --8--.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*